US007667381B2

(12) United States Patent
Cho et al.

(10) Patent No.: US 7,667,381 B2
(45) Date of Patent: Feb. 23, 2010

(54) ELECTRON EMISSION DEVICE AND ELECTRON EMISSION DISPLAY DEVICE USING THE SAME

(75) Inventors: Jin-Hui Cho, Yongin-si (KR); Sang-Jo Lee, Yongin-si (KR); Su-Bong Hong, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 400 days.

(21) Appl. No.: 11/583,755

(22) Filed: Oct. 18, 2006

(65) Prior Publication Data

US 2007/0085467 A1 Apr. 19, 2007

(30) Foreign Application Priority Data

Oct. 19, 2005 (KR) ..... 10-2005-0098507

(51) Int. Cl.
*H01J 1/62* (2006.01)
*H01J 9/02* (2006.01)

(52) U.S. Cl. ..... 313/495; 313/336; 313/497; 445/49; 445/50; 445/51

(58) Field of Classification Search ..... 313/495–497, 313/309, 336, 351; 445/23–25, 49–51
See application file for complete search history.

(56) References Cited

U.S. PATENT DOCUMENTS

| | | | | | |
|---|---|---|---|---|---|
| 5,370,972 | A * | 12/1994 | Saia et al. | ..... | 430/311 |
| 5,786,659 | A * | 7/1998 | Takagi et al. | ..... | 313/309 |
| 5,828,163 | A * | 10/1998 | Jones et al. | ..... | 313/336 |
| 5,838,095 | A * | 11/1998 | Tanaka et al. | ..... | 313/309 |
| 6,211,608 | B1 * | 4/2001 | Raina et al. | ..... | 313/309 |
| 6,635,983 | B1 * | 10/2003 | Raina et al. | ..... | 313/495 |
| 6,803,708 | B2 * | 10/2004 | Simon et al. | ..... | 313/311 |
| 2003/0025851 | A1 * | 2/2003 | Cheng et al. | ..... | 349/61 |
| 2005/0236963 | A1 * | 10/2005 | Kang et al. | ..... | 313/495 |
| 2005/0242707 | A1 * | 11/2005 | Hwang | ..... | 313/497 |
| 2006/0219995 | A1 * | 10/2006 | Hong et al. | ..... | 257/10 |

* cited by examiner

*Primary Examiner*—Bumsuk Won
*Assistant Examiner*—Nathaniel J Lee
(74) *Attorney, Agent, or Firm*—Knobbe Martens Olson & Bear LLP

(57) ABSTRACT

An electron emission device is disclosed. The electron emission device includes a resistance layer for electrically connecting a line electrode and isolate electrodes included in the cathode electrode. The cathode electrode can maintain a uniform voltage due to the resistance layer. A protection layer is located on the resistance layer. The protection layer prevents conductive elements contained in the resistance layer from diffusing over the protection layer. The protection layer also prevents the resistance layer from being oxidized.

19 Claims, 3 Drawing Sheets

ELECTRON EMISSION DEVICE AND ELECTRON EMISSION DISPLAY DEVICE USING THE SAME

CROSS-REFERENCE TO RELATED APPLICATION

This application claims priority to Korean patent application No. 10-2005-0098507 filed in the Korean Intellectual Property Office on Oct. 19, 2005, and all the benefits accruing therefrom under 35 U.S.C.§119, the content of which is herein incorporated by reference in their entirety.

BACKGROUND OF THE INVENTION

1. Field of the Invention

The present invention relates to an electron emission device.

2. Description of the Related Technology

Generally, a hot or cold cathode can be used as an electron emission source in an electron emission device. There are several types of cold cathode electron emission devices, such as a field emitter array (FEA) electron emission device, a surface conduction emission (SCE) electron emission device, a metal-insulator-metal (MIM) electron emission device, a metal-insulator-semiconductor (MIS) electron emission device, and so on.

Among these electron emission devices, the FEA electron emission device includes cathode and gate electrodes as driving electrodes for controlling electron emission units and emission of electrons thereof. Materials having a low work function or a high aspect ratio are used for constituting an electron emission unit in the FEA electron emission device. For example, carbon-based materials such as carbon nanotubes, graphite, and diamond-like carbon have been developed to be used in an electron emission unit in order for electrons to be easily emitted by an electrical field in a vacuum.

The plurality of electron emission units are arrayed on a substrate to form an electron emission device, and the electron emission device is combined with another substrate on which phosphors and anode electrodes are formed to produce an electron emission display device.

SUMMARY OF CERTAIN INVENTIVE ASPECTS

One aspect of the invention provides an electron emission device including i) a substrate, ii) a cathode electrode located on the substrate, iii) an electron emission unit for electrically connecting the cathode electrode, and iv) a gate electrode electrically insulated from the cathode electrode. The cathode electrode includes i) a first electrode having an opening, ii) a second electrode located within the opening, iii) a resistance layer for electrically connecting the first and second electrodes, and iv) a protection layer. The protection layer is located on the resistance layer such that a conductive element contained in the resistance layer does not diffuse beyond the protection layer.

The protection layer may include a surface configured to contact the resistance layer, the conductive element may not diffuse into the surface, and the protection layer may include a surface facing away from the resistance layer. The conductive element may not diffuse beyond the surface, and it may diffuse into the protection layer. The protection layer may include an insulating material that is not p-type doped, and the insulating material may include amorphous silicon. A thickness of the protection layer may be greater than a thickness of the resistance layer, and it may be in the range of about 20 nm to about 200 nm. The resistance layer may include an entire surface that faces away from the substrate, wherein the entire surface may be covered with the protection layer. At least one edge of the resistance layer may be adjacent to an edge of the protection layer, and the protection layer may partially cover the first and second electrodes.

Another aspect of the present invention provides an electron emission display device including i) opposing first and second substrates, ii) phosphor layers located on the second substrate, iii) a cathode electrode located on the first substrate, iv) an anode electrode located on the second substrate, v) an electron emission unit for electrically connecting the cathode electrode, and vi) a gate electrode electrically insulated from the cathode electrode. The cathode electrode includes i) a first electrode having an opening, ii) a second electrode located within the opening, iii) a resistance layer for electrically connecting the first and second electrodes, and iv) a protection layer. The protection layer is located on the resistance layer such that a conductive element contained in the resistance layer does not diffuse beyond the protection layer.

Another aspect of the present invention provides a method of manufacturing an electron emission device including i) providing a substrate, ii) providing a cathode electrode on the substrate, iii) providing a resistance layer on the cathode electrode such that the resistance layer is configured to electrically connect the first and second electrodes, iv) providing a protection layer on the resistance layer, and v) providing a gate electrode so as to be electrically insulated from the cathode electrode. The cathode electrode includes i) a first electrode having an opening, and ii) a second electrode located within the opening. The resistance layer may include amorphous silicon that is p-type doped. The protection layer may include amorphous silicon that is not p-type doped.

In one embodiment, the method further includes dry etching the resistance layer and the protection layer together such that at least one edge of the resistance layer is adjacent to an edge of the protection layer. Alternatively, the method further includes cleaning a surface of the resistance layer before providing a protection layer on the resistance layer. The method may further include i) providing an insulating layer on the cathode electrode, and ii) etching the insulating layer by using hydrofluoric acid. The electron emission unit may maintain a space for emitting electrons through the insulating layer, and the insulating layer may include a silicon oxide.

Another aspect of the invention provides an electron emission device, comprising: i) a gate electrode, ii) a cathode electrode configured to emit electrons based on a voltage difference between the gate and cathode electrodes, iii) a resistance layer formed on the cathode electrode, iv) a protection layer formed on the resistance layer and v) an insulating layer formed on the protection layer. The protection layer may substantially completely cover the resistance layer. The resistance layer may contain a semiconductor material which is configured to diffuse during a thermal process. The protection layer may be configured to prevent the diffusion from penetrating into the insulating layer.

DETAILED DESCRIPTION OF CERTAIN INVENTIVE EMBODIMENTS

Figure 1:
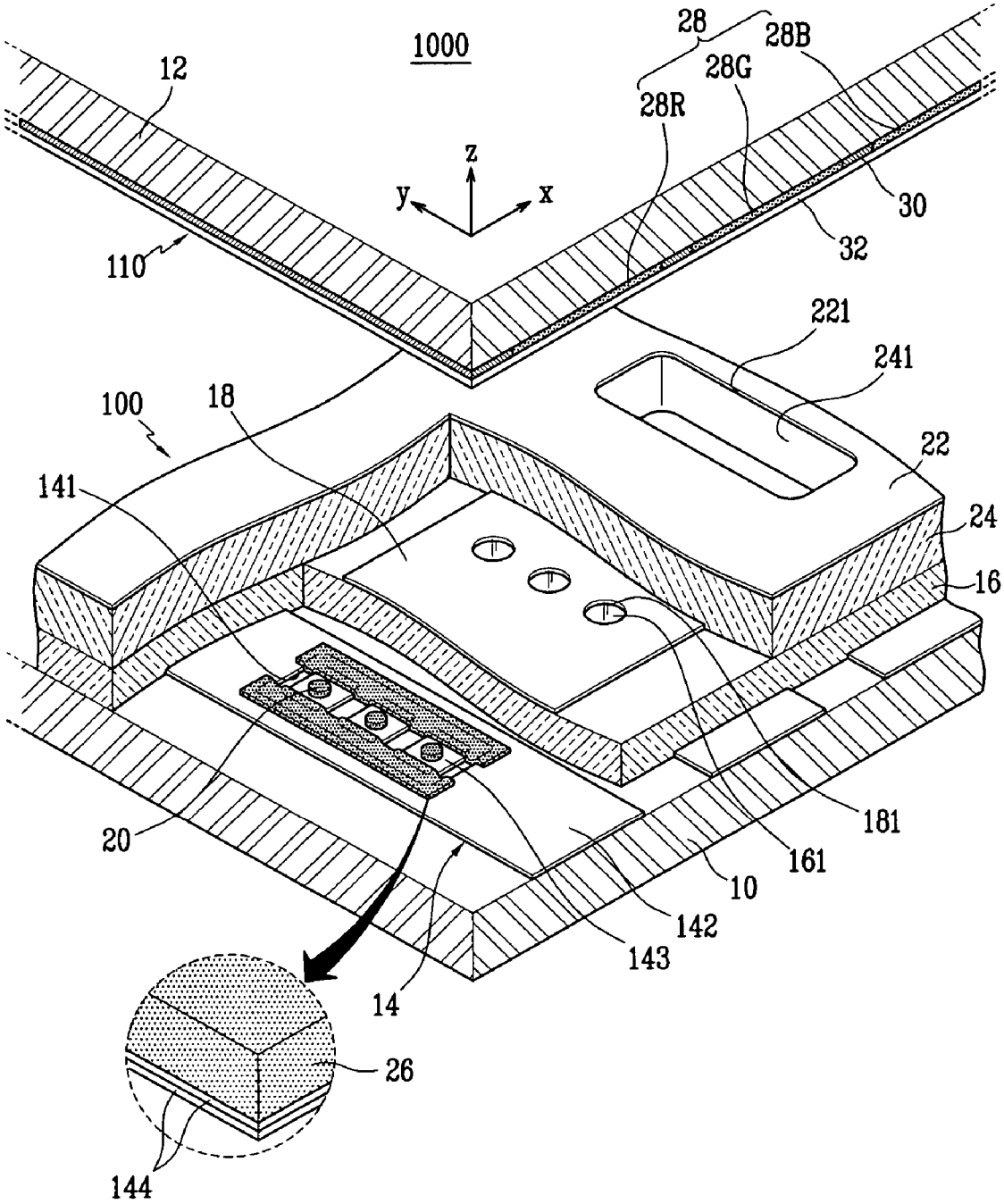
FIG. 1 is a partial exploded perspective view of the electron emission display device in accordance with an embodiment.

With reference to the accompanying drawings, embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawings to refer to the same or like parts.

It will be understood that when an element is referred to as being "on" another element, it can be directly on the other element or intervening elements may be present there between. In contrast, when an element is referred to as being "directly on" another element, there are no intervening elements present.

It will be understood that, although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to limit the scope of the invention. As used herein, the singular forms "a", "an", and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper", "over", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross-section illustrations that are schematic illustrations of embodiments of the present invention. As such, variations from the shapes of the illustrations as a result, for example, of manufacturing techniques and/or tolerances, are to be expected. Thus, embodiments should not be construed to limit the invention to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Although an FEA electron emission display device in which electron emission units contain materials for emitting electrons by using electric fields in a vacuum is mentioned below, embodiments of the present invention are not limited thereto. One embodiment of the present invention can be easily adapted to other types of electron emission display devices.

FIG. 1 illustrates a partially exploded view of the electron emission display device 1000 in accordance with an embodiment.

As illustrated in FIG. 1, the electron emission display device 1000 includes first and second substrates 10 and 12 facing each other. The first and second substrates 10 and 12 are located to be parallel to each other with a predetermined distance therebetween. A sealing member (not shown) is disposed on edges of the first and second substrates 10 and 12 such that they are attached to each other. The internal space surrounded by the two substrates 10 and 12 and the sealing member is evacuated to approximately $10^{-6}$ torr to form a vacuum vessel.

Electron emission units 20 are located on a surface of the first substrate 10 facing the second substrate 12, and they constitute an electron emission device 100 with the first substrate 10. The electron emission device 100 is assembled with the second substrate 12 and a light emitting unit 110 is provided on the second substrate 12, thereby constituting the electron emission display device 1000. In one embodiment, the light emitting unit 110 may emit light to a non-self emissive display device such as LCD. In this embodiment, the non-self emissive display device may use the light as a back light source.

Cathode electrodes 14 are formed in a stripe pattern on the first substrate 10, and a first insulating layer 16 is located on the entire surface of the first substrate 10 while covering the cathode electrodes 14. Gate electrodes 18 are also formed in a stripe pattern on the first insulating layer 16 so as to cross the cathode electrodes 14.

In one embodiment, a pixel area may be defined as a crossing area of the cathode electrode 14 and the gate electrode 18. The cathode electrode 14 includes a line electrode 142, a plurality of isolate electrodes 143, and resistance layers 144 in the pixel area. An opening 141 is formed in the line electrode 142. The plurality of isolate electrodes 143 are located within the opening 141 and are spaced apart from the line electrodes 142. The resistance layers 144 are located at left and right sides of the isolate electrodes 143, and electrically connect the line electrode 142 and the isolate electrodes 143. The resistance layers 144 partially cover the opening 141, and also partially cover the line electrode 142 and the isolate electrodes 143. As a result, a contact resistance between the line electrode 142 and the isolate electrodes 143 is reduced. One end of the line electrode 142 is configured to electrically be connected to an external circuit (not shown) and a driving voltage is applied to the line electrode 142 through the external circuit.

In one embodiment, the resistance layer 144 is made of a material with a specific resistance in the range of approximately 10,000 Ωcm to about 100,000 Ωcm. The specific resistance of the material may be greater than that of a general conductive material contained in the line electrode 142 and the isolate electrodes 143. The material may include, for example, p-type doped amorphous silicon.

In one embodiment, even if an unstable driving voltage is applied to the line electrode 142 or if a sudden voltage drop occurs in the line electrode 142, a stable driving voltage can be continuously applied to the electron emission unit 20 due to the resistance layer 144. Therefore, electron emission properties of the electron emission unit 20 can be uniformly maintained.

The electron emission unit 20 is located on the isolate electrode 143. The electron emission unit 20 contains materials that are capable of emitting electrons, such as carbon-based or nanometer-sized materials, when an electric field is formed. The electron emitting unit 20 may contain, for example, carbon nanotubes, graphite, graphite nanofibers, diamond, diamond-like carbon, $C_{60}$, silicon nanowire, and combinations thereof. The electron emission unit 20 may have a sharp tip and be mainly made of, for example, molybdenum, silicon, and so on. The openings 161 and 181 are formed in the first insulating layer 16 and the gate electrodes 18, respectively, in order for the electron emission unit 20 to maintain a space for emitting electrons.

A focusing electrode 22 is located on a second insulating layer 24. Therefore, the gate electrode 18 is insulated from the focusing electrode 22. Openings 241 and 221 are provided in the second insulating layer 24 and the focusing electrode 22, respectively, such that electron beams emitted from the electron emission unit 20 pass through the openings 241 and 221. One set of the openings 241 and 221 may be formed on each pixel area. As a result, electrons emitted from a pixel area are focused well.

The enlarged circle of FIG. 1 illustrates a corner portion of the resistance layer 144 and a protection layer 26. Two or more resistance layers 144 may be formed together. In one embodiment, the entire surface of the resistance layer 144 is covered with the protection layer 26, and at least one edge of the resistance layer 144 is adjacent to an edge of the protection layer 26.

The resistance layer 144 includes a conductive element (or a semiconductor material), for example, a p-type doped element, for electrically connecting the line electrode 142 and the isolate electrode 143. The conductive element has a tendency to easily diffuse into an adjacent layer during a heating process. Thus, if it diffuses into the insulating layer 16, the insulating property of the insulating layer can be easily destroyed. As a result, electrodes located on both surfaces of the insulating layer 16 can be electrically connected and then be short circuited. To make matters worse, the resistance layer 144 may be easily oxidized during the heating process.

In one embodiment, in order to avoid the above undesirable phenomenon, the protection layer 26 is located on the resistance layer 144. Then, the conductive elements contained in the resistance layer 144 may be blocked to diffuse into the protection layer 26. Even if the conductive elements diffuse into the protection layer 26, the diffusion cannot reach the insulation layer 16 through the protection layer 26.

In one embodiment, the protection layer 26 includes first and second surfaces. The first surface contacts the first insulating layer 16, and the second surface contacts the resistance layer 144.

In one embodiment, the conductive elements cannot diffuse beyond the first surface. In this embodiment, even if the conductive element diffuses from the resistance layer 144 into the protection layer 26, the diffusion cannot penetrate into the first insulating layer 16 beyond the protection layer 26*tt*. As a result, due to the protection layer 26, the diffusion of the conductive elements does not affect the first insulating layer 16 even during a heating process. Therefore, the first insulating layer 16 can still maintain its original insulating property.

In addition, since the resistance layer 144 is not oxidized even during a thermal process due to the protection layer 26, the resistance of the resistance layer 144 is not significantly changed. Therefore, a stable voltage can be continuously applied to the electron emission unit 20, and as a result, electron emission uniformity of the pixels is maintained well and it is possible to obtain uniform brightness all over a display surface of a large-scaled display device.

The protection layer 26 may contain an insulating material that is not p-type doped. The insulating material may contain, for example, amorphous silicon. Therefore, the protective layer 26 is prevented from being conductive.

In one embodiment, the protection layer 26 has sufficient thickness such that the diffusion of the conductive element cannot reach the insulating layer 16. In one embodiment, as illustrated in the enlarged circle of FIG. 1, the thickness of the protection layer 26 is significantly greater than that of the resistance layer 144. In another embodiment, the thickness of the protection layer 26 is slightly greater (not shown) than that of the resistance layer 144. The thickness of the protection layer 26 may be in the range of about 20 nm to about 200 nm, and in this embodiment, it is very difficult or almost impossible for the conductive element contained in the resistance layer 144 to diffuse into the first insulating layer 16 beyond the protection layer 26. If the thickness of the protection layer 26 is too little, it may be difficult to effectively protect the resistance layer 144 and thus the resistance layer 144 can be easily oxidized. On the contrary, if the thickness of the protection layer 26 is too great, it may take too much time to form the protection layer 26 and thus manufacturing time and costs increase.

In one embodiment, phosphor layers 28, for example, red, green, and blue phosphor layers 28R, 28G, and 28B are formed to be spaced apart from each other on a surface of the second substrate 12 facing the first substrate 10. Black layers 30 are formed between each of the phosphor layers 28 in order to absorb ambient light. The phosphor layers 28 are located so that each phosphor layer 28R, 28G, and 28B corresponds to a pixel area.

In addition, anode electrodes 32 that are made of a metallic film such as aluminum are formed on the phosphor layers 28 and the black layers 30. External high voltages, which are sufficient to accelerate electron beams, are applied to the anode electrodes 32 and are then maintained at high electric potentials by the anode electrodes 32. Among the visible rays emitted from the phosphor layers 28, visible rays directed to the first substrate 10 is reflected toward the second substrate 12 by the anode electrodes 32, and thereby brightness is enhanced.

In one embodiment, the anode electrodes 32 can be made of a transparent conductive film such as indium tin oxides (ITO), for example. In this case, the anode electrode may be located between the second substrate and the phosphor layers.

In addition, the transparent conductive films and metallic films can be formed together as an anode electrode.

Figure 2:
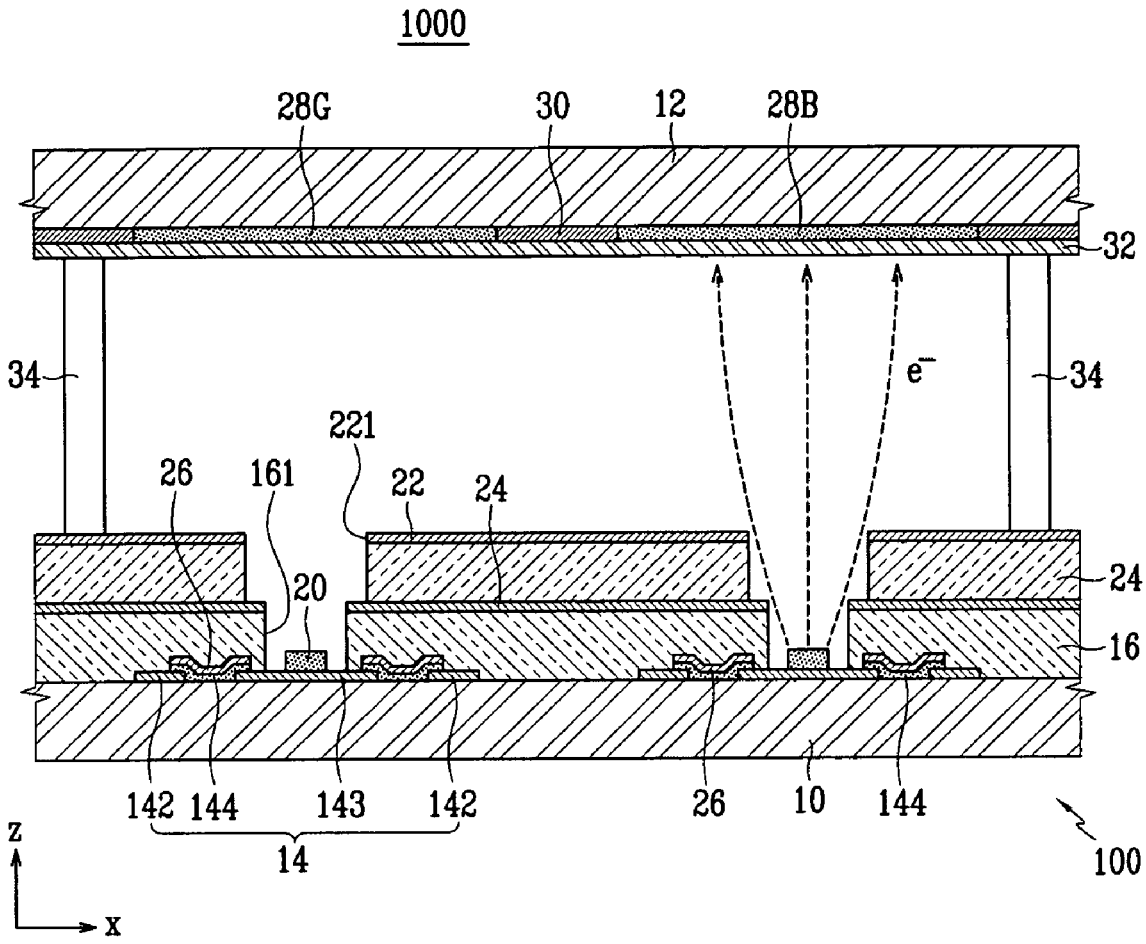
FIG. 2 is a partial cross-section view of the electron emission display device in accordance with an embodiment.

FIG. 2 illustrates a partial cross-section of the electron emission display device in accordance with an embodiment.

Spacers 34 are located between the two substrates 10 and 12, thereby supporting the substrates 10 and 12 against a compressing force applied to a vacuum space therebetween. The spacers 34 uniformly maintain a gap between the two substrates 10 and 12, and they are generally located directly beneath the black layers 30 in order for them to be invisible from the outside.

Some elements included in the electron emission device 100 are manufactured by the following process. The line electrodes 142 and isolate electrodes 143 are formed on the first substrate 10. Next, materials for forming the resistance layer 144 and materials for forming the protection layer 26 are continuously deposited on the entire surface of the first substrate 10. Then, the resistance layer 144 and the protection layer 26 can be simultaneously patterned, and they may be dry etched together, leaving only a portion of the resistance layer 144 that can electrically connect the line electrode 142 and the isolate electrode 143.

Then, the first insulated layer 16 is formed on the protection layer 26, and it may be etched by using hydrofluoric acid (HF), for example, and then the opening 161 may be formed.

In one embodiment, the electron emission display device 1000 is driven by external voltages which are applied to the cathode electrode 14, the gate electrode 18, the focusing electrode 22, and the anode electrode 32. Scan driving voltages are applied to one electrode among the cathode electrode 14 and the gate electrode 18, and thus the one electrode functions as a scanning electrode. In addition, data driving voltages are applied to the other electrode among the cathode electrode 14 and the gate electrode 18, and thus the other electrode functions as a data electrode. Voltages for focusing the electron beams, such as 0V or negative direct current voltages of several to several tens of volts, are applied to the focusing electrode 22, while positive direct current voltages of several hundreds to several thousands of volts are applied to the anode electrode 32 for accelerating electron beams.

Then, electric fields are formed around the electron emission unit 20 at the pixels where the voltage difference between the cathode electrode 14 and the gate electrode 18 exceeds a threshold value, and thereby electrons are emitted therefrom. The emitted electrons are focused on a center portion of the electron beams while passing through the opening 221 of the focusing electrodes 22. They are also attracted by the high voltage applied to the anode electrode 32 and collide against the corresponding phosphor layers, for example, 28G and 28B. Thus, light is emitted from the electron emission display device 1000 and an image is displayed.

In the above driving process of the electron emission display device, since the resistance layer 144 maintains a uniform resistance due to the protection layer 26, electron emission properties of the electron emission unit 20 are more uniformly maintained. As a result, electron emission properties of the pixels are uniform and the brightness can be enhanced.

Figure 3:
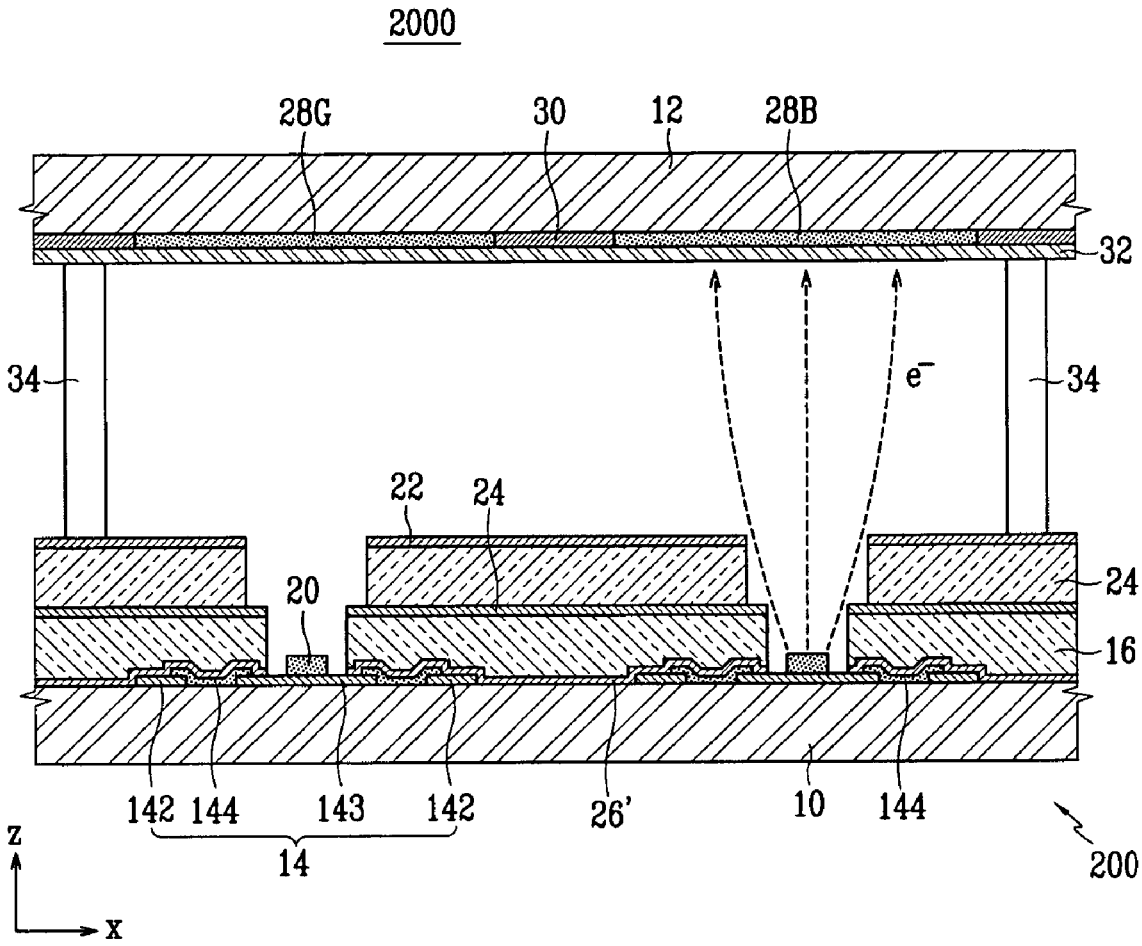
FIG. 3 is a partial cross-section view of the electron emission display device in accordance with another embodiment.

FIG. 3 illustrates a partial cross-section of the electron emission display device 2000 in accordance with another embodiment.

In one embodiment, as illustrated in FIG. 3, a protection layer 26' is located on the entire surface of the first substrate 10, and it covers almost all the surface of the cathode electrodes 14. In this embodiment, the protection layer 26' protects not only an upper surface of the protection layer 144 but also a side surface thereof, such that the resistance layer 144 is effectively prevented from being oxidized.

Some of the elements included in the electron emission device 200 are manufactured by the following process. After materials for forming the resistance layer 144 are deposited on the first substrate 10, materials for forming the protection layer 26 are deposited thereon. In this case, oxidized films can be naturally formed on a surface of the resistance layer 144. Therefore, they can be removed by cleaning with, for example, hydrofluoric acid, before materials for forming the protection layers 26 are deposited.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. An electron emission device, comprising:
a substrate;
a cathode electrode located on the substrate;
an electron emission unit electrically connected to the cathode electrode; and
a gate electrode electrically insulated from the cathode electrode,
wherein the cathode electrode comprises
a first electrode having an opening,
a second electrode located within the opening,
a resistance layer configured to electrically connect the first and second electrodes, wherein the resistance layer contains a conductive element, and
a protection layer, and
wherein the protection layer is located on the resistance layer such that the conductive element does not diffuse beyond the protection layer, and wherein the resistance layer and protection layer are fully embedded in an insulating layer.

2. The device of claim 1, wherein the protection layer comprises a surface contacting the resistance layer, and
wherein the diffusion of the conductive element does not penetrate into the surface of the protection layer.

3. The device of claim 1, further comprising an insulating layer formed on the protection layer, wherein the conductive element does not diffuse into the insulating layer.

4. The device of claim 1, wherein the protection layer comprises an insulating material that is not p-type doped.

5. The device of claim 4, wherein the insulating material of the protection layer is amorphous silicon.

6. The device of claim 1, wherein the thickness of the protection layer is greater than that of the resistance layer.

7. The device of claim 6, wherein the thickness of the protection layer is in the range of about 20 nm to about 200 nm.

8. The device of claim 1, wherein the protection layer substantially completely covers the resistance layer.

9. The device of claim 8, wherein at least one edge of the resistance layer is adjacent to an edge of the protection layer.

10. The device of claim 1, wherein the protection layer partially covers the first and second electrodes.

11. An electron emission display device, comprising:
first and second substrates opposing each other;
phosphor layers located on the second substrate;
a cathode electrode located on the first substrate;

an anode electrode located on the second substrate;

an electron emission unit electrically connected to the cathode electrode; and a gate electrode electrically insulated from the cathode electrode wherein the cathode electrode comprises a first electrode having an opening, a second electrode located within the opening, a resistance layer configured to electrically connect the first and second electrodes and containing a material, wherein the material is configured to diffuse during a heating process, and a protection layer formed on the resistance layer and configured to at least partly block the diffusion, wherein the resistance layer and protection layer are fully embedded in an insulating layer.

12. A method of manufacturing an electron emission device, comprising:

providing a substrate;

providing a cathode electrode on the substrate, wherein the cathode electrode comprises a first electrode having an opening, and a second electrode located within the opening;

providing a resistance layer on the cathode electrode so as to electrically connect the first and second electrodes;

providing a protection layer on the resistance layer;

fully embedding the resistance layer and protection layer in an insulating layer; and providing a gate electrode so as to be electrically insulated from the cathode electrode.

13. The method of claim 12, wherein the resistance layer comprises amorphous silicon which is p-type doped, and wherein the protection layer comprises amorphous silicon which is not p-type doped.

14. The method of claim 12, further comprising dry etching the resistance layer and the protection layer together such that at least one edge of the resistance layer is adjacent to an edge of the protection layer.

15. The method of claim 12, further comprising cleaning a surface of the resistance layer before providing the protection layer on the resistance layer.

16. The method of claim 12, further comprising:

providing an insulating layer on the cathode electrode; and etching the insulating layer by way of hydrofluoric acid, wherein the electron emission unit maintains a space configured to emit electrons through the insulating layer.

17. The method of claim 16, wherein the insulating layer comprises silicon oxide.

18. The device of claim 11, further comprising a non-self emissive display device configured to receive light which is emitted from the phosphor layer and passes through the second substrate.

19. An electron emission device, comprising:

a gate electrode;

a cathode electrode configured to emit electrons based on a voltage difference between the gate and cathode electrodes;

an electron emission unit formed on the cathode electrode;

a resistance layer formed on the cathode electrode and at a side of the electron emission unit;

a protection layer formed on the resistance layer; and an insulating layer formed on the protection layer, wherein the protection layer substantially completely covers the resistance layer, wherein the resistance layer contains a semiconductor material which is configured to diffuse during a thermal process, wherein the protection layer is configured to prevent the diffusion from penetrating into the insulating layer, and wherein the resistance layer is thinner than the electron emission unit.

* * * * *